US006381883B1

(12) United States Patent
Le et al.

(10) Patent No.: US 6,381,883 B1
(45) Date of Patent: May 7, 2002

(54) CONTINUOUS PRESSURE DECATISING OF FABRICS AND SETTING OF STAPLE FIBRE ASSEMBLIES

(75) Inventors: Cuong Viet Le, Highton; Nhan Gia Ly, Baulkham Hills; Peter William Chudleigh, Pennant Hills, all of (AU); David Henry Tester, Ilkley (GB); David Graham Phillips, Highton (AU)

(73) Assignee: The Commonwealth of Australia Commonwealth Scientific and Industrial Research Organization, Campbell (AU)

( * ) Notice: Subject to any disclaimer, the term of this patent is extended or adjusted under 35 U.S.C. 154(b) by 0 days.

(21) Appl. No.: 09/284,912

(22) PCT Filed: Oct. 16, 1997

(86) PCT No.: PCT/AU97/00691

§ 371 Date: Aug. 16, 1999

§ 102(e) Date: Aug. 16, 1999

(87) PCT Pub. No.: WO98/17853

PCT Pub. Date: Apr. 30, 1998

(30) Foreign Application Priority Data

Oct. 17, 1996 (AU) ..... PO3042

(51) Int. Cl.[7] ..... D06F 61/08
(52) U.S. Cl. ..... 38/49
(58) Field of Search ..... 38/3, 11, 49; 68/5 R, 68/5 D, 8, 5 C; 8/149.3; 34/114, 122; 100/55 R

(56) References Cited

U.S. PATENT DOCUMENTS 3,779,047 A * 12/1973 Fleissner
4,197,663 A * 4/1980 Reidel ..... 38/3
4,625,433 A * 12/1986 Giancola et al.
4,756,036 A * 7/1988 Reidel
5,123,134 A * 6/1992 Alberto

FOREIGN PATENT DOCUMENTS

| | | |
|---|---|---|
| DE | 3316127 A1 | 11/1984 |
| GB | 2157410 A | 10/1985 |
| GB | 2201434 A | 9/1988 |
| WO | WO94/10367 | 5/1994 |

OTHER PUBLICATIONS

"Seal for an air–loaded oscillating conveyor", Research Disclosure, vol. 177, No. 121 May 1974 by Havant, Great Britain, p. 18.

* cited by examiner

*Primary Examiner*—Ismael Izaguirre
(74) *Attorney, Agent, or Firm*—Sughrue Mion, PLLC

(57) ABSTRACT

A method and apparatus for continuously pressure decatising a fabric include a rotatable drum (12) around which an endless belt (15) is arranged to travel for conveying a fabric (19) (and optionally a moisture laden textile (20)) between the facing surfaces of the belt (15) and the drum (12). The drum (12) is heated and fabric (19) is pressed between the belt and the drum as it is conveyed through the apparatus. The fabric (19) is subjected to pressurized saturated steam, which may be generated by evaporation of the moisture in textile (20) when it contacts the heated drum, as it is pressed. Various options other than use of a moisture laden textile (20) for supplying the steam are disclosed. The invention involves enclosing the drum in a pressure vessel (14) within which a compressed air atmosphere at ambient temperature is maintained. The surrounding compressed air atmosphere can be used to control the steam temperature, that is, the saturated steam temperature can be changed by changing the pressure of the surrounding compressed air. The surrounding compressed air atmosphere also reduces the sealing requirements for the steam treatment and belt wear. The method and apparatus are also applicable for setting staple fibers.

24 Claims, 4 Drawing Sheets

CONTINUOUS PRESSURE DECATISING OF FABRICS AND SETTING OF STAPLE FIBRE ASSEMBLIES

TECHNICAL FIELD

This invention relates to a method, and apparatus for performing the method, for the continuous pressure decatising of fabrics. The invention also extends to a method and apparatus for continuously setting staple fibers, wherein the staple fibers are contained in an assembly of fibers such as a sliver, roving, strand, yarn or the like. The invention is particularly suitable for setting wool fibre assemblies and decatising woollen and wool containing fabrics (hereinafter the term wool fabric or the like is to be understood as encompassing fabrics containing a mixture of wool and another or other fibers) and will be described hereinafter with reference to such fibers and fabrics, but it is to be understood that the invention is applicable to other staple fibers, and to other fabrics such as, for example, cottons and rayons which are generally decatised to set the material, enhance lustre or impart some dimensional stability.

BACKGROUND

Pressure decatising is a finishing treatment whereby a wool fabric's physical and dimensional form is enhanced and then stabilised by the use of heat, moisture, pressure and time. Generally, a pressure decatising method produces a permanent change in fabric properties by the action of heat and pressurised steam at greater than 100 kPa (1 atm) pressure on a mechanically constrained fabric, and is usually performed during the final stages of fabric production for several reasons:

(a) to develop desirable aesthetic qualities in the fabric such as handle, lustre and smoothness, (b) to improve the dimensional stability of the fabric particularly for purposes of garment assembly, and (c) to permanently set or preserve these qualities during fabric use. A continuous pressure decatising method imparts a permanent finish to a fabric in two distinct operations, fabric relaxation/setting followed by fabric stabilisation, For fabric relaxation/setting, the fabric is for example subjected to mechanical compression in an ambient of steam at high pressure and temperature, which allows the fibers to relax and adopt a new conformation. For fabric stabilisation, the fabric undergoes cooling and drying processes which set the fabric in its new conformation and also bring it back to room ambient. Similarly, individual fibers in an assembly of staple fibers can be treated by heat and pressurised steam whilst mechanically constrained, and then be cooled and dried to set them.

One known type of continuous decatising apparatus comprises a perforated heated drum having an endless belt held in tension and wrapped around most of the circumference of the drum. The fabric, which it conveyed between the surface of the drum and the belt as the drum rotates, is thus pressed between the drum and the belt surface. Besides being heated by the drum, the fabric is also subjected to steam which is introduced through the drum perforations. Alternatively a laminar-shaped enclosure may be formed between an impermeable pressure belt and an unperforated drum. Pressurised steam is generated in this enclosure by vaporisation of moisture carried in by the belt-fabric sandwich. The "Super finish-GFP" machine made by Menschner (now MTECH) provides an example of this latter apparatus.

The pressure belt in this known type of apparatus simultaneously compresses and seals the fabric against the rotating drum. However the level of permanent set that can be imparted to the fabric is limited by the tensile strength of the pressure belt because it is the tension in this belt that provides the seal to maintain a saturated atmosphere within the fabric to set the fibers. Furthermore, the belts in this apparatus wear quickly and require frequent periodic and thus costly maintenance because of their continuously high tensile stress and high temperature working conditions. A further problem with this apparatus arises from the dual role of the pressure belt, that is, it must simultaneously form a high pressure seal with the drum and also apply mechanical pressure to the fabric. To make a leak-tight seal with the drum, the sealing pressure exerted by the belt must exceed the pressure of the enclosed steam, but the mechanical pressure actually applied to the fabric will be reduced by the "cushioning" effect of this steam. Consequently it is difficult to control the fabric compression as it will depend on the steam pressure within the enclosure.

Another known type of continuous pressure decatising apparatus, of which the "Ekofast" machine developed by WIRA (Wool Industries Research Association) and Mather & Platt provides an example, involves transporting the fabric between two end less belt conveyors through an autoclave containing saturated steam. At least one of the conveyors is permeable and the fabric is subjected to impulsive compression by nip rollers. The belt conveyors in this apparatus are tensioned to maintain a desirable fabric finish. Although this tensioning is not as high as in the first described known apparatus, the belts have to be permeable and belt wear is still a problem. This apparatus can impart a reasonable permanent finish to wool fabric, however the required treatment time is much longer than that in the first described known apparatus.

Generally, known continuous pressure decatising apparatus require complex sealing arrangements due to the need to seal an enclosure of saturated steam at high pressure and yet allow a fabric to enter the enclosure, flat set and emerge from the apparatus in a continuous fashion. Example disclosures which deal With this sealing problem for continuous decasting apparatus are provided by European Patent 0533295 and International Application No. PCT/IT92/00114 (WO94/10367). A further problem is the need to ensure adequate insulation of the enclosures of saturated steam.

In summary, known continuous pressure decatising methods and apparatus involve problems with belt wear, the sealing of enclosures for saturated steam and insulating those enclosures. The solutions to these problems offered to date tend to be complex and thus costly. Furthermore, it has been difficult to date to closely control and readily adjust the steaming conditions, namely the temperature of the saturated or superheated steam to which a fabric is subjected during a continuous decatising method.

DISCLOSURE OF THE INVENTION

The present invention is based on the realisation that the steaming conditions in a continuous pressure decatising method may be controlled using a surrounding pressurised atmosphere, preferably of air and preferably at ambient temperature, and controlling the pressure of that atmosphere, and that such a surrounding atmosphere could also reduce the belt wear, sealing and insulation problems of the prior art. It wag also realised that this principle of using an enclosing compressed gas for controlling steaming conditions could be applied more generally for the setting of staple textile fibers as such.

Accordingly, in a first aspect of the present invention, there is provided a method for continuously pressure decatising a fabric including the steps of (i) establishing a region of compressed gas having a pre-determined pressure, (ii) continually conveying a fabric through the region of compressed gas by and between two conveying members, (iii) applying saturated or Superheated steam at a high temperature to the fabric within the region of compressed gas and simultaneously pressing the fabric between the two conveying members, wherein the high temperature of the saturated or superheated steam is determined substantially by the predetermined pressure of the region of compressed gas.

In a second aspect, the invention provides a method for setting staple fibers wherein the fibers are contained in an assembly of fibers such as a sliver, roving, strand, yarn or the like, the method including the steps of (i) establishing a region of compressed gas having a predetermined pressure, (ii) continually conveying the assembly of fibers through the region of compressed gas, (iii) applying saturated or superheated steam at a high temperature to the assembly of fibers within the region of compressed gas and simultaneously constraining the fibers in the assembly of fibers, wherein the high temperature of the saturated or superheated steam is determined substantially by the Predetermined pressure of the region of compressed gag The method of the first and second aspects of the invention may additionally include a step of passing cool gas through the fabric, or the assembly of fibers, to cool it and reduce its regain whilst the fabric is pressed between the two conveying members, or whilst the assembly of fibers is constrained, for stabilising the fabric or the fibers. This additional step is preferably also conducted within the region of compressed gas.

According to a third aspect of the invention, there is provided apparatus for continuously pressure decatising a fabric including first and second conveying members for continuously transporting a fabric along a predetermined path, wherein each conveying member includes a facing surface and the fabric is pressed between the facing surfaces as it is transported by the first and second members along the predetermined path, wherein a treatment zone for the fabric is substantively defined by the facing surfaces of the first and second members and a portion of the length of the predetermined path; drive means associated with the first or the second member for moving said first or second member for transporting the fabric; means for providing a saturated or superheated steam atmosphere within the treatment zone; and a pressure vessel for containing a compressed gas; wherein the treatment zone is contained within the pressure vessel and wherein the pressure of the compressed gas is controllable to thereby controllably establish a high temperature for the saturated or superheated steam atmosphere within the treatment zone.

According to a fourth aspect of the invention, there in provided apparatus for setting staple fibers Wherein the fibers are contained in an assembly of fibers such as a sliver, roving, strand, yarn or the like, the apparatus including means for conveying the assembly of fibers through a treatment zone, means for constraining the fibers as they pass through the treatment zone, means for providing a saturated or superheated steam atmosphere at a high temperature within the treatment zone, and a pressure vessel for containing a pressurized gas, wherein the treatment zone is contained within the pressure vessel and wherein the pressure of the compressed gas is controllable to thereby controllably establish a high temperature for the saturated or superheated steam atmosphere within the treatment zone.

Preferably the compressed gas is air at ambient temperature. Thus, according to the invention, it is possible to change the saturated steam temperature by adjusting the pressure of the surrounding compressed air. The temperature of saturated steam at a given pressure is obtainable from Steam Tables at the equivalent vapour pressure. Also, with such a pressurised atmosphere, the sealing of the treatment zone is not critical because of the surrounding high air pressure. That is, because of the surrounding high air pressure, localized saturated (or superheated) steam is effectively maintained in the treatment zone (the degree of leakage of steam that may occur from the treatment zone is insignificant to the functioning of the decatising process). Thus the first and second conveying members may be permeable or impermeable.

The treatment zone for the fabric is generally the space between the facing surfaces of the two (or the first and second) conveying members over a length of the path of the fabric through the apparatus and there are various options available for providing a saturated or superheated steam atmosphere within this zone. At least one of the conveying members should be heated for the decatising (and thus it will have a heating arrangement associated with it) and this heating may be employed for generating the steam.

Thus a saturated or superheated steam atmosphere can be established within the treatment zone, simultaneously with the pressing and conveying of a fabric therethrough, by appropriately heating one of the conveying members such that moisture on or in the fabric is rapidly evaporated. Preferably moisture is applied to the fabric prior to its passage through the treatment zone. This can be done by spraying a surface of the fabric with moisture, which surface should be the one that faces the facing surface of the heated conveying member. Alternatively, a moisture laden textile material can be arranged to travel through the treatment zone sandwiched between the fabric being treated and the facing surface of one of the conveying members, which facing surface is suitably heated so as to rapidly evaporate the moisture that is conveyed into the treatment zone by the textile material. In this situation a permeable belt conveying member may be used in order to release excess moisture from the fabric during treatment.

In an alternative aspect, a process and apparatus according to the invention includes introducing steam into the treatment zone through the first conveying member or the second conveying member, or both, which will require that the conveying member(s) concerned be permeable. For example, one of the conveying members may be a rotatable drum and steam may be introduced into the treatment zone from inside the drum via suitable perforations through its surface. In another example, wherein the first and second conveying members comprise a permeable belt travelling over a drum, a steam chamber or the like may be provided over a portion of the belt over the drum (effectively the belt/drum interface provides a wall for the chamber). Thus in this example, pressurized steam is introduced into the treatment zone through the belt. The enclosure of such a steam chamber in a pressurized atmosphere such as compressed air, according to the invention, helps maintain the saturated steam at a temperature corresponding to this pressure and alleviates the sealing requirements for the chamber relative to the belt, thus reducing a problem which exists with prior art arrangements that employ similar steam chambers.

The first and second conveying members could be constituted by endless belt conveyors. Preferably, however, the first conveying member is a heated cylindrical drum, the outer surface of which provides one of said facing surfaces, and the second conveying member is an endless belt that travels around the drum whereby fabric, which is sandwiched between the drum and the belt, can be continuously conveyed through the apparatus via rotation of the drum. Thus, the drive means associated with the first or second member may be a driving arrangement for rotating the drum.

In this preferred drum and belt arrangement for the apparatus of the invention, the facing surface of the belt is not required to establish a seal with the facing surface of the drum along the longitudinal edges of a fabric. All that is required of the belt is that it be tensionable to exert sufficient lateral pressure to maintain a desired finish on the fabric.

In the above described preferred form of apparatus for the invention, the drum may be mounted for rotation within a pressure chamber with the belt arranged to enter and exit the chamber through suitable sealing arrangements. Compressed air at room temperature can be supplied to the chamber to maintain a suitable pressure therein while the fabric travels through. This arrangement allows for ready variation of the pressure within the chamber.

Embodiments of the invention will now be described, by way of non limiting example only, with reference to the accompanying drawings.

BEST MODES FOR CARRYING OUT THE INVENTION

Figure 1:
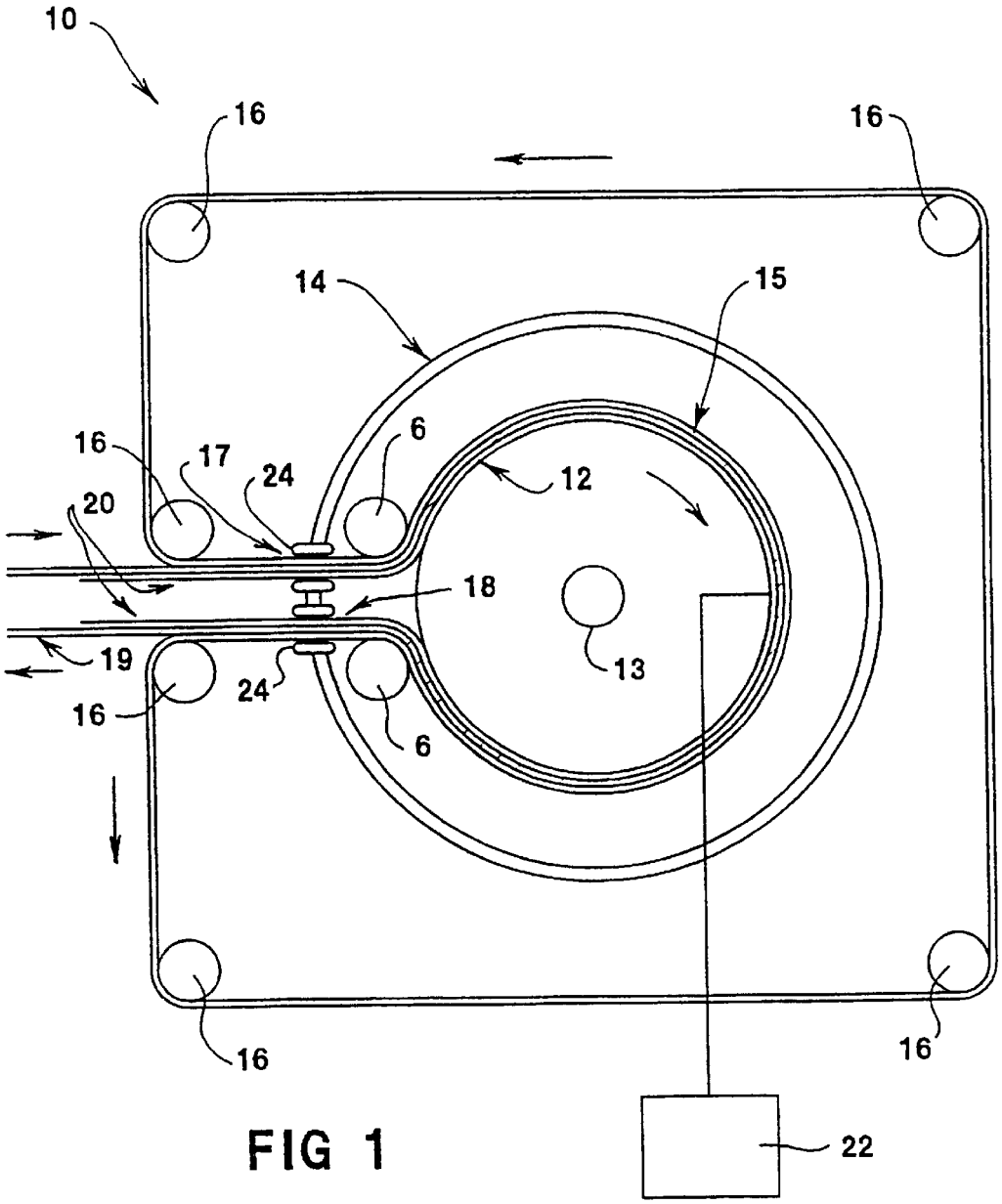
FIG. 1 shows a simplified diagrammatic illustration of an apparatus for the continuous decatising of a fabric according to the invention.

The apparatus 10 shown in the FIG. 1 illustration includes a steel drum 12 which is mounted for rotation, about a shaft 13, within a pressure vessel 14. Preferably pressure vessel 14 is cylindrical (as illustrated), although it may be any other suitable shape. An endless belt 15 is arranged around a series of eight rollers 16 such that it travels into vessel 14 through an entry aperture 17, around about 80% of the circumferential surface of drum 12 and then out an exit aperture 18. One of the rollers 16 is adjustable in a known way for adjusting the tension in belt 15, also shaft 13 or one of the rollers 16 is driven. A fabric 19 is fed to the apparatus 10 such that it is sandwiched between endless belt 15 and drum 12. A textile material 20 (or wrapper) for example of cotton which is made wet, can also be fed to apparatus 10 such that it is sandwiched between fabric 19 and the surface of drum 12. The entry and exit apertures 17 and 18 for vessel 14 each include a sealing arrangement 24 (which may include rollers) to minimise the leakage of compressed air from vessel 14. Suitable seals are known in the art and are thus not further described herein.

Drum 12 includes a suitable arrangement (shown substantially by block 22) for heating its surface up to, for example, a temperature of about 180° C. It will be evident from FIG. 1 that a clockwise rotation of drum 12 will convey fabric 19 and the wet cotton wrapper 20 through a treatment zone between the heated outer facing surface of drum 12 and the inner facing surface of belt 15, which zone extends around the drum starting from about where the belt 15 contacts the surface of drum 12 after entry into vessel 14 and finishing about where it leaves the drum just prior to its exit from vessel 14.

Belt 15 may be made of an impermeable silicone material. As a fabric 19 is transported through the vessel 14, it is compressed between belt 15 and drum 12 sufficiently to ensure the fabric retains its flatness, that is, to ensure that a desirable fabric finish is maintained. This compression is provided by tension in belt 15 assisted by the force which the pressurised atmosphere within vessel 14 exerts on the belt. That is, it is to be understood that belt 15 is tensioned, but this tensioning and the consequential lateral pressure that the belt exerts on the fabric 19 is relatively low in that the belt's tension is required only to exert reasonable lateral pressure to maintain the fabric flatness. Simultaneously, the interaction between the heated surface of drum 12 and wet surface of wrapper 20 causes a rapid evaporative/condensative heat transfer process to occur which establishes a saturated (or superheated, depending oil the temperature and the amount of moisture) steam atmosphere within the treatment zone.

Use of a wet cotton wrapper 20, which gives a saturated regain to the fabric, is not essential and as an alternative wrapper 20 can be omitted and the surface of the fabric 19 which contacts the heated surface of drum 12 can be moistened prior to entering the apparatus 10. For example, free water can be applied to the surface of fabric 19 by a spray (not shown). Alternatively, steam may be introduced into the treatment zone via perforations in the drum 12, or from a steam chamber arrangement provided within the pressure vessel 14 via a permeable belt.

Figure 4:
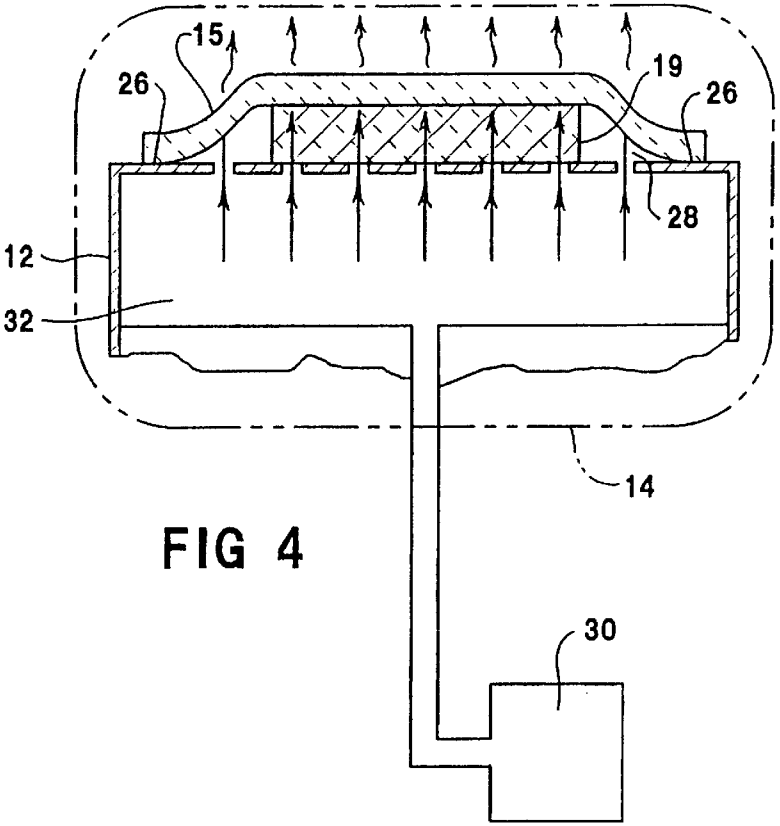
FIG. 4 is also a similar illustration to FIG. 2 relating to ;a third embodiment of the invention.
Figure 2:
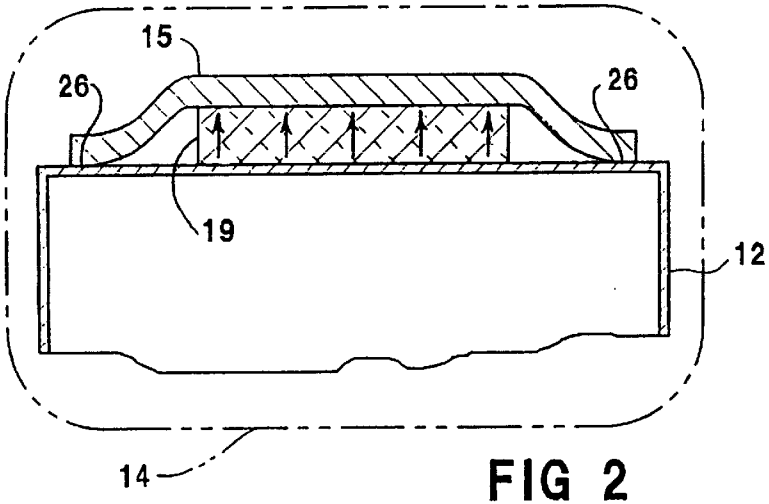
FIG. 2 is a diagrammatic illustration for explaining the operation of the invention according to a first embodiment thereof.
Figure 3:
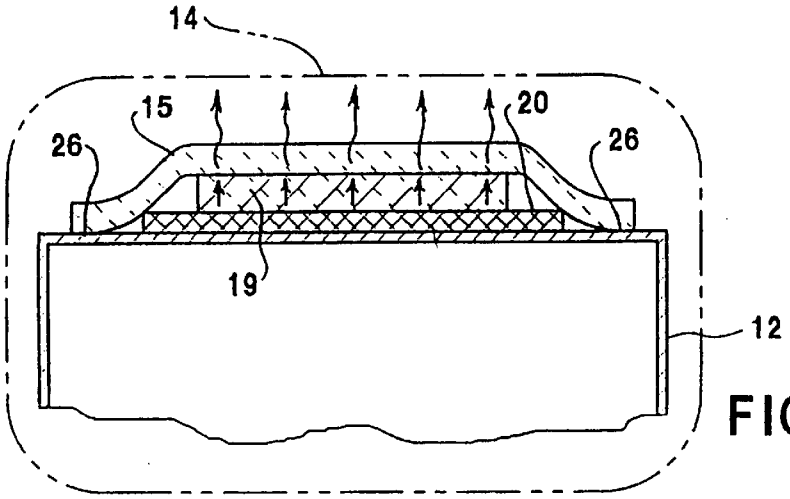
FIG. 3 is a similar illustration to FIG. 2 relating to a second embodiment of the invention.

FIGS. 2, 3 and 4 are schematic cross-sectional representations (for explaining the operation of the invention) of similar apparatus to that shown in FIG. 1, that is, in these views the conveying members movement is in a direction that is normal to the page. Features in these views which correspond with the above described features in FIG. 1 have been accorded the same reference numerals. Thus, FIG. 2 shows a heated drum 12 around which an endless belt 15 travels with a fabric 19 sandwiched between the outer facing surface of the drum 12 and the inner facing surface of the belt 15. Pressure vessel 14 is schematically represented by an enclosing broken line. It contains compressed air at room temperature.

The FIG. 2 embodiment is similar to the FIG. 1 embodiment except it does not employ a moisture laden cotton wrapper 20.

The endless belt 15 of FIG. 2 is impermeable and it presses the fabric 19 against the outerfacing surface of heated drum 12. In this embodiment steam is generated by the evaporation of moisture in or on the fabric 19. The, pressurized environment within vessel 14 means that belt 15 need not be a high tensile belt to seal the treatment zone, which zone is defined between the facing surfaces of the belt 15 and drum 12. Thus it is not critical that the belt 15 seal against the facing surface of drum 12 laterally of the edges of the fabric 19 (see references 26). For example if the air pressure within vessel 14 is at 300 kPa (3 atmospheres) (gauge), belt 15 only needs to exert an additional pressure of, for example, 50 kPa (0.5 atm) to form a pressurized enclosure for sealing the fabric and set it flat. The steam generated in this enclosure is actually subjected to a gauge pressure of 350 kPa (3.5 atm) and therefore the corresponding saturated steam temperature therein is 148° C. (from Steam Tables), provided that the temperature of the heated drum 12 is above this temperature. For a wool fabric 19, provided there is sufficient moisture in the fabric initially, preferably 25% regain or higher, a high level of permanent set can be imparted to the wool fabric in less than 30 secs. The fabric 19 can also be wetted prior to entering pressure vessel 14 for improving the level of permanent set imparted, however a drying cycle may be required immediately afterward to stabilize the surface finish.

In the embodiment shown by FIG. 3, belt 15 is permeable and a moisture laden cotton wrapper 20 (as in FIG. 1) is sandwiched between the outer facing surface of heated drum 12 and the fabric 19. A micro-climate of saturated steam at high temperature, as required to net the wool fibers of fabric 19, can still exist in the treatment zone despite the permeability of belt 15 because of the surrounding region of compressed air in vessel 14. Steam that leaks through the permeable belt 15 will mix with the compressed air and eventually condense on the cold surface of pressure vessel 14 and ca be drained away. Because the belt 15 is permeable, there will be an insignificant "cushioning effect" by the saturated steam atmosphere within the treatment zone, thus the belt 15 is only required to exert sufficient mechanical pressure to flat set the fabric 19. The evaporation of water held by cotton wrapper 20 is controlled by the drum 12 temperature while the saturated steam temperature can be controlled by controlling the compressed air pressure within vessel 14. For example, if the air pressure of the compressed air in vessel 14 is 300 kPa (3 atm gauge pressure), the saturated steam temperature in the treatment zone will be about 144° C. (from Steam Tables) provided that the temperature of the heated drum is set at about 10° C. higher to facilitate a high rate of evaporation. The amount of steam required is controlled by the wetness of cotton wrapper 20. Once all the water has evaporated, the heated drum 12 can act as a medium to dry the treated fabric 19, giving it a stable surface finish as it emerges from the pressure vessel 14. Thus the need for an additional drying cycle as required in other processes can be eliminated.

In the embodiment shown by FIG. 4, belt 15 is permeable and the cylindrical surface of drum 12 contains perforations 28. Saturated steam from a supply 30 is fed to a chamber 32 within drum 12 and forced therefrom through perforations 28, fabric 19 and permeable belt 15.

In the FIGS. 3 and 4 embodiments, the lateral pressure exerted on the fabric 19 can be controlled more exactly than that in the FIG. 2 embodiment because of the permeability of belt 15, thus it is expected that these embodiments would give a more consistent treatment.

In experiments that the applicant has conducted on two fabrics, one plain weave and one twill fabric, both preconditioned at 25% initial regain, permanent set values of up to 71% have been achieved.

Generally, it is thought that the level of permanent set increases with increasing air pressure inside vessel 4, higher temperature of drum 12 and longer treatment/resident times. However high drum temperatures and longer treatment times can result in yellowing of wool fabrics. The applicant is continuing to conduct experiments to optimise all controlling variables, including the initial regain of fabric which was not changed in the above mentioned experiments. Generally, the applicant's experiments have shown that to obtain permanent set values of 60–85% within a treatment time of about 15 seconds, for fabrics at 18–25% regain, the absolute pressure of the saturated steam needs to be 450–600 kPa (4.5–6 atm.).

The invention also includes the option of preheating belt 15 prior to its wrapping around a fabric 19 on drum 12 to modify the finish on the adjacent surface of fabric 19. It is also within the scope of the invention that the belt 15 tension be varied between batches of fabric to manipulate the setting process and hence modify fabric properties such as handle, smoothness and hygral expansion.

It will be appreciated that the apparatus depicted in FIG. 1 generally provides for the fabric relaxation/setting stage of a pressure decatising process and that the fabric 19 may then be subjected to a fabric stabilising stage. Suitable fabric stabilisation operations are known in the art. However it is possible to include in the one apparatus both a relaxation/setting and a stabilising stage as in the apparatus depicted by FIGS. 5 and 6.

Figure 5:
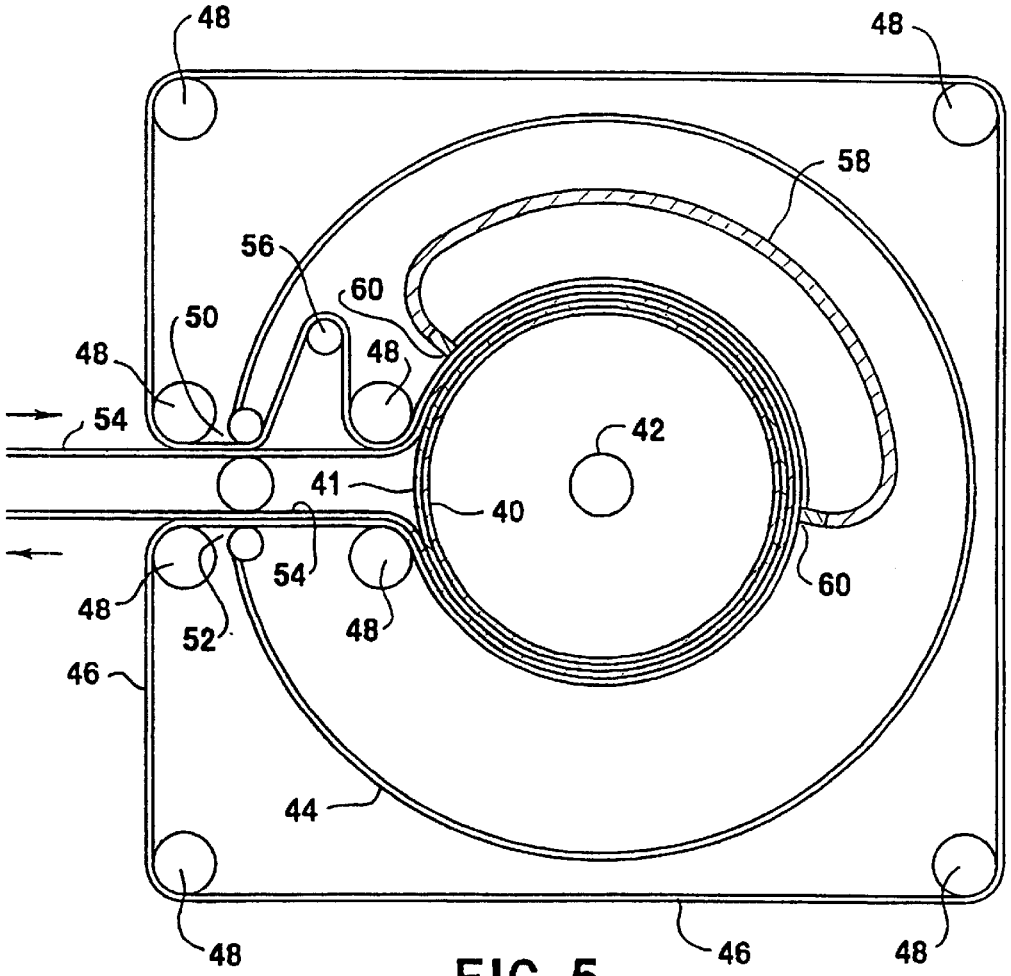
FIG. 5 shows a further embodiment of apparatus according to the invention.

FIG. 5 shows a further embodiment wherein a heated perforated drum 40 is mounted for rotation via shaft 42 within a pressure vessel 44. The outer surface of drum 40 may be covered with a permeable textile material 41. An endless permeable belt 46 is arranged around a series of rollers 48 such that it travels into vessel 44 through an entry aperture 50, around 80–90% of the circumferential surface of drum 40 and then out an exit aperture 52. Sealing arrangements are provided for the entry and exit apertures as is known. A fabric 54 is conveyed through vessel 44 sandwiched between material 41 on drum 40 and endless belt 46. A tensioning arrangement 56 for endless belt 46 is located within pressure vessel 44 rather than outside the vessel because this allows better control of the belt tension.

A steam chamber 58 is arranged over a portion of the circumferential surface of drum 40 within vessel 44 and may include a seal arrangement 60 at the interface between its longitudinal and circumferentially extending walls and the belt 46. The belt 46/fabric 54/material 41/drum 40 interface completes the steam chamber. The belt 46/fabric 54/material 41/drum 40 interface is permeable such that saturated steam can pass therethrough. Steam chamber 58 is arranged relative to drum 40 such that the fabric 54 is subjected to saturated steam soon after it contacts drum 40 and such that the steaming is terminated whilst the fabric still has a distance to travel on the drum which is sufficient for cooling and drying it. Thus this apparatus eliminates the need for an additional drying (stabilisation) cycle.

In operation of the apparatus shown in FIG. 5, compressed air at approximately 450 kPa (4.5 atm) gauge is maintained in pressure vessel 44 and a compressed air atmosphere of approximately 400 kPa (4 atm) gauge is maintained within drum 40, with the pressure within steam chamber 58 at approximately 450 kPa (4.5 atm) gauge. The seals 60 are not critical because of the surrounding compressed air at 450 kPa. Air needs to be continually pumped into vessel 44 to maintain the pressure therein depending on the flow rate through the belt 46/fabric 54/material 41/drum 40 interface and losses through apertures 50 and 52.

Figure 6:
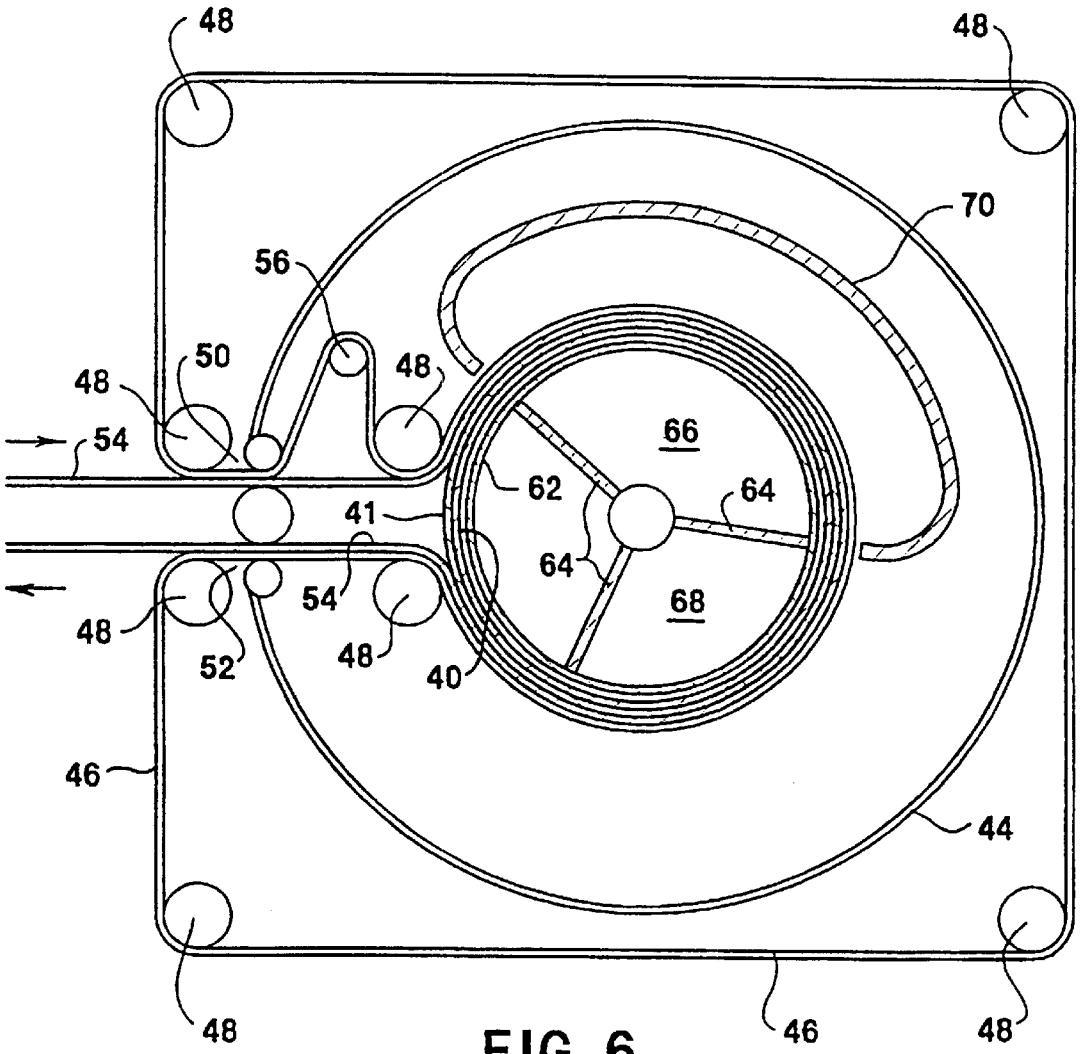
FIG. 6 shows a modified form of the FIG. 5 apparatus.

FIG. 6 shows a modification of the apparatus of FIG. 5 (similar features in the two figures have been accorded the same reference numeral) wherein a cylindrical chamber 62 is provided interiorly of the drum 40. Chamber 62 is fixed, ie. it is stationary and drum 40 rotates around it. The cylindrical wall of drum 40 is closely adjacent the cylindrical wall of chamber 62. Chamber 62 includes internal partitions 64 for providing at least two compartments 66 and 68 therein, and the outer circumferential surface of chamber 62 is perforated. A cold shield 70 (in place of steam chamber 58) is provided over the belt 46/fabric 54/material 41/drum 40 interface opposite and in alignment with compartment 66 of chamber 62. In operation of this apparatus, compressed air at approximately 400 kPa (gauge) is maintained in vessel 44 whilst compressed air at approximately 450 kPa (gauge) is maintained in compartment 68 and saturated steam at approximately 450 kPa gauge is maintained in compartment 66. Thus the fabric 54 undergoes a relaxation/setting stage as it proceeds over compartment 66 and a stabilisation stage (cooling and drying) as it proceeds over compartment 68. Cold shield 70, which may be water cooled, is for trapping moisture in the steam through condensation, which condensation can be drained away.

In relation to application of the invention for continuously setting staple fibers, wherein the staple fibers are contained in an assembly of fibers such as a sliver, roving, strand, yarn or the like, an apparatus for performing the method may be similar to that disclosed in the applicant's Australian Patent No. 645026 (61669/90), which wag published internationally as No. WO 91102835, with the addition of an enclosing pressure vessel for containing compressed air for controlling the temperature of the steaming treatment. The disclosure of this patent is to be taken as incorporated herein by this cross-reference. In this apparatus the fibers in an assembly of fibers are constrained by imparting false twist to the assembly. Also, any of the above described embodiments of FIGS. 1 to 6 may be used for handling an assembly of fibers in place of a fabric 19.

The invention described herein is susceptible to variations, modifications and/or additions other than those specifically described and it is to be understood that the invention includes all such variations, modifications and/or additions which fall within the spirit and scope of the following claims.

What is claimed is:

1. A method for continuously pressure decatising a fabric including the steps of (i) establishing a region of compressed gas having a predetermined pressure, (ii) continually conveying a fabric through the region of compressed gas by and between two conveying members, (iii) applying saturated or superheated steam at a high temperature to the fabric within the region of compressed gas and simultaneously pressing the fabric between the two conveying members, wherein the high temperature of the saturated or superheated steam is determined substantially by the predetermined pressure of the region of compressed gas.

2. A method as claimed in claim 1 including heating one of said two members such that moisture contained in or on the fabric is evaporated to thereby provide the saturated or superheated steam.

3. A method as claimed in claim 1 including continuously conveying a moisture laden textile material through the region of compressed gas by and between said two conveying members such that the moisture laden textile material is in facing contact with the fabric, and heating the one of said two conveying members that is adjacent the moisture laden textile material such that the moisture contained in or on that textile material is evaporated to thereby provide the saturated or superheated steam.

4. A method as claimed in claim 1 wherein the two conveying members are permeable and the saturated or superheated steam is passed through the two conveying members for application to the fabric from a pressurized supply of the steam.

5. A method as claimed in claim 1 including an additional step of passing gas through the fabric to cool the fabric and reduce its regain while the fabric is pressed between the two conveying members for stabilising the fabric.

6. A method as claimed in claim 5 wherein the additional step is conducted within the region of compressed gas.

7. A method as claimed in any one of claims 1 to 6 wherein the predetermined pressure of the region of compressed gas is varied to thereby vary the high temperature of the saturated or superheated steam.

8. A method as claimed in any one of claims 1 to 6 wherein the compressed gas is air at ambient temperature.

9. A method for setting staple fibers wherein the fibers are contained in an assembly of fibers comprising a sliver, roving, strand, or yarn, the method including the steps of (i) establishing a region of compressed gas having a predetermined pressure, (ii) continually conveying the assembly of fibers through the region of compressed gas, (iii) applying saturated or superheated steam at a high temperature to the assembly of fibers within the region of compressed gas and simultaneously constraining the fibers in the assembly of fibers.

10. Apparatus for continuously pressure decatising a fabric including first and second conveying members for continuously transporting a fabric along a predetermined path, wherein each conveying member includes a facing surface and the fabric is pressed between the facing surfaces as it is transported by the first and second conveying members along the predetermined path, wherein a treatment zone for the fabric is substitutively defined by the facing surfaces of the first and second conveying members and a portion of the length of the predetermined path; drive means associated with the first or the second conveying member for moving said first or second conveying member for transporting the fabric; means for providing a saturated or superheated steam atmosphere within the treatment zone; and a pressure vessel for containing a compressed gas; wherein the treatment zone is contained within the pressure vessel and wherein the pressure of the compressed gas is controllable to thereby controllably establish a high temperature for the saturated or superheated steam atmosphere within the treatment zone.

11. Apparatus as claimed in claim 10 wherein the means for providing a saturated or superheated steam atmosphere within the treatment zone includes a heating arrangement associated with the first or the second conveying member, wherein the heating arrangement heats its associated first or second conveying member for evaporating moisture contained in or on the fabric when the fabric contacts said heated conveying member.

12. Apparatus as claimed in claim 11 wherein the first and second conveying members are impermeable.

13. Apparatus as claimed in claim 10 wherein the means for providing a saturated or superheated steam atmosphere within the treatment zone includes a heating arrangement associated with the first or the second conveying member and a moisture laden textile material, wherein the moisture laden textile material is arranged to be transported through the treatment zone together with the fabric to be decatised between the facing surfaces of the first and second conveying members with the moisture laden textile material lying adjacent the facing surface of the conveying member with which the heating arrangement is associated, wherein the heating arrangement heats its associated first or second conveying member for evaporating moisture contained in or on the moisture laden textile material when that material contacts said heated conveying member.

14. Apparatus as claimed in claim 13 wherein said first or second conveying member which is not associated with the heating arrangement is permeable.

15. Apparatus as claimed in claim 10 including a heating arrangement associated with the first or the second conveying member, wherein the first and the second conveying members are permeable and wherein the means for providing a saturated or superheated steam atmosphere within the treatment zone includes a chamber for providing a pressurized supply of steam, wherein the chamber is arranged for steam to pass therefrom through the first and the second conveying members and thus through a fabric therebetween.

16. Apparatus as claimed in claim 10 wherein the first conveying member is a drum which is mounted for rotation within the pressure vessel, and wherein the second conveying member is an endless belt which enters the pressure vessel at an entry aperture, travels around the drum and then exits the pressure vessel at an exit aperture adjacent its entry aperture, wherein seals are provided at the entry and exit apertures in the pressure vessel for maintaining the pressure of a compressed gas therein, wherein a fabric is continuously transportable through the pressure vessel when sandwiched between the endless belt and surface of the drum, wherein the means for providing a saturated or superheated steam atmosphere within the treatment zone includes a heating arrangement associated with the drum for heating its facing surface.

17. Apparatus as claimed in claim 16 wherein the drum and the endless belt are impermeable, and wherein the heating arrangement associated with the drum for heating its facing surface is for evaporating moisture contained in or on the fabric when the fabric contacts said healed drum surface.

18. Apparatus as claimed in claim 16 wherein the drum is impermeable and the endless belt is permeable, wherein the means for providing a saturated or superheated steam atmosphere additionally includes a moisture laden textile material which is transportable through the treatment zone, together with the fabric to be decatised, between the facing surfaces of the drum and the fabric, wherein the heating arrangement heats the facing surface of the drum for evaporating the moisture contained in or on the moisture laden textile material when that material contacts said heated facing surface.

19. Apparatus as claimed in claim 16 wherein the drum and the endless belt are permeable and the means for providing a saturated or superheated steam atmosphere within the treatment zone includes a chamber for providing a pressurized supply of steam, wherein the chamber is arranged for steam to pass therefrom through both the drum and the endless belt with the fabric therebetween.

20. Apparatus as claimed in claim 19 wherein the chamber is located inside the drum such that the pressurized steam enters the treatment zone through the drum.

21. Apparatus as claimed in claim 19 wherein the chamber is located over the endless belt such that the pressurized steam enters the treatment zone through the endless belt.

22. Apparatus as claimed in claim 20 wherein a further chamber is located inside the drum for passing pressurized gas at ambient temperature through the fabric after it passes the first defined (steam) chamber for cooling and drying the fabric within the pressure vessel.

23. Apparatus as claimed in claim 21 wherein the chamber extends around a portion of the circumferential surface of the drum such that a further portion thereof is available for gas from the pressure vessel to pass through the fabric for cooling and drying the fabric within the pressure vessel.

24. Apparatus for setting staple fibers wherein the fibers are contained in an assembly of fibers comprising a sliver, roving, strand, or yam, the apparatus including means for conveying the assembly of fibers through a treatment zone, means for constraining the fibers as they pass through the treatment zone, means for providing a saturated or superheated steam atmosphere at a high temperature within the treatment zone, and a pressure vessel for containing a pressurized gas, wherein the treatment zone is contained within the pressure vessel and wherein the pressure of the compressed gas is controllable to thereby controllably establish ;a high temperature for the saturated or superheated steam atmosphere within the treatment zone.

* * * * *

UNITED STATES PATENT AND TRADEMARK OFFICE

CERTIFICATE OF CORRECTION

PATENT NO. : 6,381,883 B1
DATED : May 7, 2002
INVENTOR(S) : Cuong Viet Le et al.

It is certified that error appears in the above-identified patent and that said Letters Patent is hereby corrected as shown below:

Title page,
Change "[73] Assignee: The Commonwealth of Australia Commonwealth Scientific and Industrial Research Organization, Campbell (AU)"
to -- [73] Assignee: Commonwealth Scientific and Industrial Research Organization, Campbell (AU) --

Column 2,
Line 22, change "end less" to -- endless --;
Line 38, change "With" to -- with --;
Line 61, change "wag" to -- was --.

Column 3,
Line 6, change "Superheated" to -- superheated --;
Line 27, change "Predetermined" to -- predetermined --.

Column 6,
Line 27, change "oil" to -- on --;
Line 59, change "fabric 19. The," to -- fabric 19. The --.

Column 7,
Line 19, change "net" to -- set --;
Line 25, change "ca be" to -- can be --.

Column 9,
Line 22, change "wag" to -- was --;

Column 11,
Line 36, change "healed" to -- heated --.

UNITED STATES PATENT AND TRADEMARK OFFICE

CERTIFICATE OF CORRECTION

PATENT NO. : 6,381,883 B1 
DATED : May 7, 2002
INVENTOR(S) : Cuong Viet Le et al.

It is certified that error appears in the above-identified patent and that said Letters Patent is hereby corrected as shown below:

Column 12,
Line 40, change "; a high" to -- a high --.

Signed and Sealed this

Eleventh Day of November, 2003

JAMES E. ROGAN
*Director of the United States Patent and Trademark Office*